US009366132B2

(12) United States Patent
Calder et al.

(10) Patent No.: US 9,366,132 B2
(45) Date of Patent: Jun. 14, 2016

(54) CONTROL LINE SPACE OUT TOOL

(75) Inventors: Neal Calder, Aberdeen (GB); Michael John Maclurg, Inverurie (GB)

(73) Assignee: Weatherford Technology Holdings, LLC, Houston, TX (US)

( * ) Notice: Subject to any disclaimer, the term of this patent is extended or adjusted under 35 U.S.C. 154(b) by 988 days.

(21) Appl. No.: 13/548,136

(22) Filed: Jul. 12, 2012

(65) Prior Publication Data

US 2013/0014942 A1 Jan. 17, 2013

(30) Foreign Application Priority Data

Jul. 14, 2011 (GB) ..... 1112109.2

(51) Int. Cl.
*E21B 47/09* (2012.01)
*E21B 47/04* (2012.01)

(52) U.S. Cl.
CPC ..... *E21B 47/04* (2013.01)

(58) Field of Classification Search
USPC ..... 166/255.1, 64
See application file for complete search history.

(56) References Cited

U.S. PATENT DOCUMENTS 3,255,822 A * 6/1966 Conrad ..... E21B 23/065 123/46 R
5,377,540 A 1/1995 Songe et al.
5,522,464 A * 6/1996 Piper ..... E21B 33/0422 166/212
6,173,788 B1 * 1/2001 Lembcke ..... E21B 17/025 166/179
2002/0157824 A1 * 10/2002 French ..... E21B 17/06 166/250.01
2004/0016549 A1 * 1/2004 Selinger ..... E21B 34/085 166/369
2009/0065200 A1 * 3/2009 Howard ..... B65H 57/04 166/255.1
2010/0326673 A1 * 12/2010 Borgstadt ..... B25J 9/1664 166/381

FOREIGN PATENT DOCUMENTS

GB 2154001 A 8/1985
SU 1079829 A1 3/1984

OTHER PUBLICATIONS

Search Report in counterpart UK Appl. No. GB1112109.2, dated Sep. 29, 2011.

* cited by examiner

*Primary Examiner* — Taras P Bemko
(74) *Attorney, Agent, or Firm* — Blank Rome LLP

(57) ABSTRACT

A control line space out tool for use in identifying the length of control line required to extend between proximal and distal locations in a wellbore is described, the control line space out tool comprises a body having a locator for locating the tool at a proximal location within a wellbore and a passage though which a control line may pass to extend to a distal location, a grip for locking onto a control line, and an actuator for operating the grip to lock onto the control line to thereby indicate the length of control line required to extend between said locations. A method of determining a length of control line required to extend between proximal and distal locations within a wellbore is also described.

16 Claims, 4 Drawing Sheets

CONTROL LINE SPACE OUT TOOL

CROSS-REFERENCE TO RELATED APPLICATIONS

This application claims priority under 35 USC 119(a) to UK Appl. No. 1112109.2, filed 14 Jul. 2011.

FIELD OF THE INVENTION

This invention relates to a control line space out tool. More particularly, the invention relates to a control line space out tool for use in a wellbore and a method of determining a length of control line which is required to extend between particular locations within a wellbore.

BACKGROUND

It is currently very difficult to accurately determine the length of control line required when installing and/or operating equipment at a given location within a wellbore, particularly when the control line is being retrofitted in existing tubing, for example within an existing completion. To date, this operation has tended to rely on a theoretical calculation of the length of control line necessary and has resulted in a long and laborious system of calculation and cross-checking in order to arrive at a best guess result. Other techniques may involve the use of depth counters which are also often unreliable.

It is therefore an aim of the present invention to provide a control line space out tool and a method of determining a length of control line required to extend between particular locations within a wellbore, which helps to alleviate the afore-mentioned problems.

SUMMARY

According to a first aspect of the present invention there is provided a control line space out tool for use in identifying the length of control line required to extend between proximal and distal locations in a wellbore, the control line space out tool comprising: a body having a locator for locating the tool at a proximal location within a wellbore, and a passage though which a control line may pass to extend to a distal location; a grip for locking onto the control line; and an actuator for operating the grip to lock onto the control line to thereby indicate the length of control line required to extend between said locations.

The present aspect of the invention therefore provides a tool which can enable an empirical measurement to be made for the length of control line required to extend between particular locations within a wellbore thereby negating the need for theoretical calculation and/or the use of depth counters. The tool may be quick and simple to operate as well as providing an accurate, repeatable and consistent approach, minimizing the potential for mistakes.

The control line space out tool may be employed to space out the control line prior to the control line being cut and coupled to a control line hanger (CLH) which is to be installed at a desired location in the wellbore.

The grip may be configured to couple the entire tool to the control line such that when the control line is retrieved from the wellbore, the tool is carried by the control line to the surface and consequently the position of the tool on the control line serves to indicate the length of control line required to reach the proximal location in the wellbore.

Alternatively, the grip may be detachable from the tool such that only the grip (and not the rest of the tool) may be pulled to the surface to indicate the length of the control line required to reach the proximal location in the wellbore. In this case, the grip may serve as an indicator indicative of the position of the tool in the wellbore.

The grip may comprise one or more rubber slips.

The actuator may comprise a pneumatic, hydraulic, mechanical or electrical arrangement for deploying the grip.

In a particular embodiment, the actuator comprises a pressurized fluid (e.g. nitrogen gas) chamber arranged, when activated, to operate a piston to force the grip into contact with the control line.

The actuator may be activated by a timer. Alternatively, the actuator may be activated by a control signal, for example, in the form of an electrical signal or a wireless communication.

The locator may comprise a recess or an outwardly projecting flange, shoulder or other projection. The locator may be configured to locate on a cooperating locator provided in the wellbore (for example, in a well head assembly or in production tubing). The wellbore locator may comprise a recess or an inwardly projecting ledge, shoulder or other projection. The tool locator, and/or the wellbore locator, may be retractable or collapsible (for example, by pressure activation or deactivation) so as to allow the tool to pass further along the wellbore. In certain embodiments, one or both of the locators may comprise a welding ring, a spring-loaded (e.g. dog) clip, or an inflatable straddle.

According to a second aspect of the present invention there is provided a method of determining a length of control line required to extend between proximal and distal locations within a wellbore comprising: mounting a control line space out tool on a control line; running the tool and control line into a wellbore; landing the tool at a proximal location in the wellbore; continuing to run the control line into the wellbore and through the control line space out tool until a distal end of the control line reaches a distal location in the wellbore; activating a grip in the control line space out tool to engage the control line; and retrieving the control line from the wellbore with the grip attached.

The control line space out tool may be mounted on the control line above a stinger assembly or other tool or device for terminating or coupling the distal end of the control line.

The step of landing the control line space out tool at the proximal location in the wellbore may comprise locating the control line space out tool on a locator provided in the wellbore.

In a particular embodiment, the control line space out tool may be located on a no-go or ledge provided in a tubing hanger back pressure value (BPV) profile and the method may be employed to determine the length of control line required to extend from a control line hanger (CLH) to be positioned on said no-go or ledge to a tool or device at said distal location, which tool or device may be engaged by a suitable stinger assembly.

Once the control line space out tool has landed at the desired location within the wellbore, the stinger assembly may be allowed to continue further into the wellbore.

The whole space out tool or just the grip may be pulled back to the surface with the control line in order to provide an accurately measured reference point for cutting and terminating the control line. Consequently, the method may further comprise cutting the control line to the length indicated by the control line space out tool. A control line hanger or other device may then be attached to the upper end of the cut control line and then run into the wellbore to position the device at the proximal location.

It should be understood that the features defined above in accordance with any aspect of the present invention or below in relation to any specific embodiment of the invention may be utilized, either alone or in combination, with any other defined feature, in any other aspect or embodiment of the invention.

BRIEF DESCRIPTION OF THE DRAWINGS

A particular embodiment of the invention will now be described with reference to the accompanying drawing, in which.

DETAILED DESCRIPTION OF CERTAIN EMBODIMENTS

Figure 1:
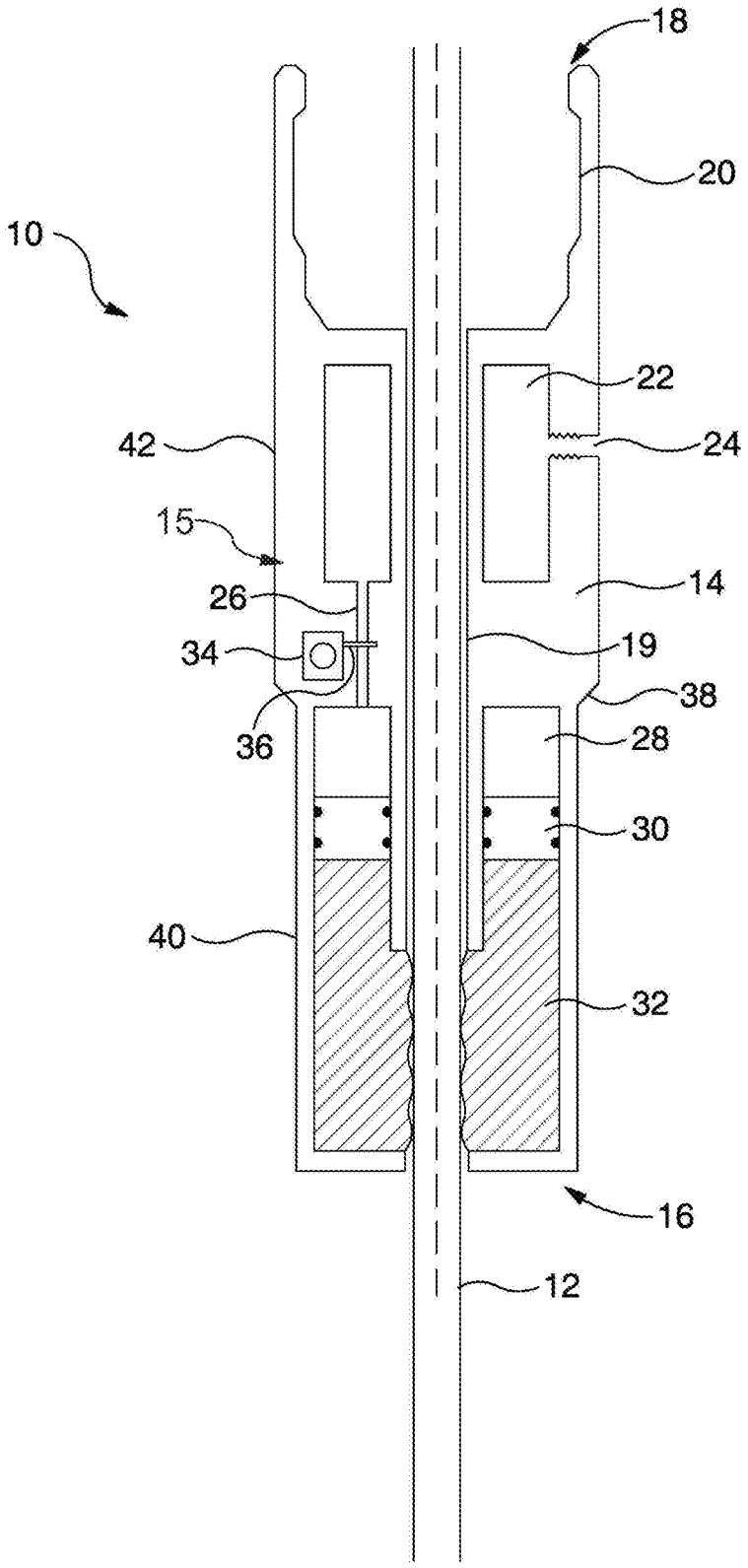
FIG. 1 shows a longitudinal cross-sectional view of a control line space out tool in accordance with an embodiment of the present invention, when gripping a control line.

With reference to FIG. 1 there is illustrated a control line space out tool 10 according to an embodiment of the present invention, in use, gripping a control line 12. The tool 10 comprises a substantially cylindrical body 14 having a first, lower, end 16 and a second, upper, end 18. An axial bore 19 is provided in the body 14 for receiving the control line 12.

Adjacent the upper end 18, the body 14 is substantially hollow and has an inner surface provided with a fishneck profile 20 for attachment to industry standard running or pulling tools.

Below the fishneck 20, the body 14 houses an annular chamber 22, which, in this embodiment, is filed with pressurized nitrogen gas through a side inlet port 24. Although not illustrated, it will be understood that a cap will be provided to close off the inlet port 24 after the chamber has been sufficiently filled with gas ready for use.

A fluid flow pipe 26 extends downwardly from the gas chamber 22 into an annular piston chamber 28. The piston chamber 28 houses an annular piston 30 which is vertically movable within the piston chamber 28 and a grip, in the form of an annular rubber slip 32, provided below the piston 30 at the lower end of the piston chamber 28.

A timer 34 is provided adjacent the fluid flow pipe 26 and is configured to open a gate 36 provided across the pipe 26 to thereby permit the pressurized gas to flow from the gas chamber 22 into the piston chamber 28, when the timer 34 has reached a pre-determined value (e.g. 10 minutes).

Figure 3:
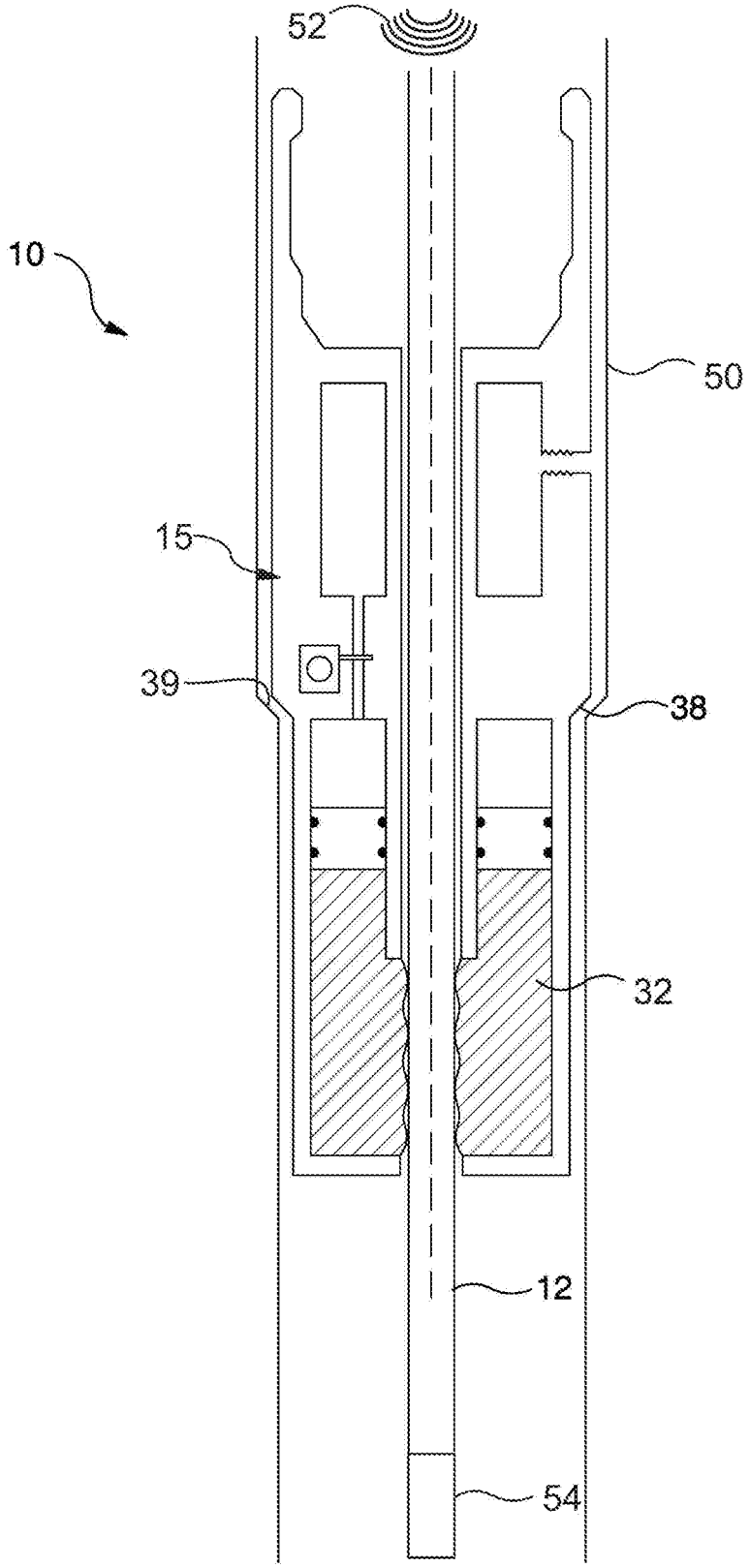
FIG. 3 shows a longitudinal cross-sectional view of the control line space out tool in accordance with the present invention, when gripping the control line and landed in a wellbore.

A locator in the form of a frusto-conical ledge 38 is provided on the body 14 at a position approximately halfway between the upper end 18 and the lower end 16. The ledge 38 forms a transition between a lower section 40 of the body 14 and an upper section 42 of the body 14. The lower section 40 has a diameter of less than the upper section 42 and the ledge 38 extends upwardly and outwardly at an angle of approximately 45° with respect to the longitudinal axis of the tool 10. Conveniently, the ledge 38 is configured to rest on a complementary no-go ledge (39: FIG. 3) which will be provided in a wellhead assembly or downhole tubing in order to locate the tool 10 thereon.

In use, the tool 10 is mounted on the control line 12 above a stinger assembly (54: FIG. 3) and run downhole into a wellbore 50. When the ledge 38 of the tool 10 lands on the complementary no-go ledge 39 provided in the wellbore 50, typically the tubing hanger back pressure valve (BPV) hanger in the wellhead assembly, the tool 10 will remain on the no-go 39 and the stinger assembly 54 may continue further into the wellbore 50 with the control line 12 passing through the tool 10 until the stinger assembly 54 reaches the desired depth. The timer 34 is set to provide sufficient time for the stinger assembly 54 to reach the desired depth, and when activated opens the gate 36 and allows pressurized gas to pass into the piston chamber 28. The pressurized gas will force the piston 30 downwardly to axially compress the rubber slip 32 which in turn will cause the slip 32 to expand radially into the bore 19 to thereby lock onto the control line 12. Once the tool 10 has locked onto the control line 12, the upper end of the control line 12 is retrieved from the wellbore 50 and brings with it the tool 10 to the surface. The position of the tool 10 on the control line 12 therefore identifies the upper end of the length of control line 12 required to extend between a control line hanger and the desired stinger assembly location.

According to a first aspect of the present invention there is provided a control line space out tool 10 for use in identifying the length of control line 12 required to extend between proximal and distal locations in a wellbore 50. The control line space out tool 10 comprises a body 14 having a locator 38 for locating the tool 10 at a proximal location within a wellbore 50, and a passage 19 though which a control line 12 may pass to extend to a distal location. The tool 10 comprises a grip 32 for locking onto the control line 12 and comprises an actuator 15 for operating the grip 32 to lock onto the control line 12 to thereby indicate the length of control line 12 required to extend between said locations.

The present aspect of the invention therefore provides a tool 10 which can enable an empirical measurement to be made for the length of control line 12 required to extend between particular locations within a wellbore 50 thereby negating the need for theoretical calculation and/or the use of depth counters. The tool 10 may be quick and simple to operate as well as providing an accurate, repeatable and consistent approach, minimizing the potential for mistakes.

The control line space out tool 10 may be employed to space out the control line 12 prior to the control line 12 being cut and coupled to a control line hanger (CLH) which is to be installed at a desired location in the wellbore 50.

The grip 32 may be configured to couple the entire tool 10 to the control line 12 such that when the control line 12 is retrieved from the wellbore 50, the tool 10 is carried by the control line 12 to the surface and consequently the position of the tool 10 on the control line 12 serves to indicate the length of control line 12 required to reach the proximal location in the wellbore 50.

Alternatively, the grip 32 may be detachable from the tool 10 such that only the grip 32 (and not the rest of the tool 10) may be pulled to the surface to indicate the length of the control line 12 required to reach the proximal location in the wellbore 50. In this case, the grip 32 may serve as an indicator indicative of the position of the tool 10 in the wellbore 50.

The grip 32 may comprise one or more rubber slips.

The actuator 15 may comprise a pneumatic, hydraulic, mechanical or electrical arrangement for deploying the grip 32.

In a particular embodiment, the actuator 15 comprises a pressurized fluid (e.g. nitrogen gas) chamber 22, 28 arranged, when activated, to operate a piston 30 to force the grip 32 into contact with the control line 12.

The actuator 15 may be activated by a timer 34. Alternatively, the actuator 15 may be activated by a control signal (52: FIG. 3), for example, in the form of an electrical signal or a wireless communication.

Figure 2:
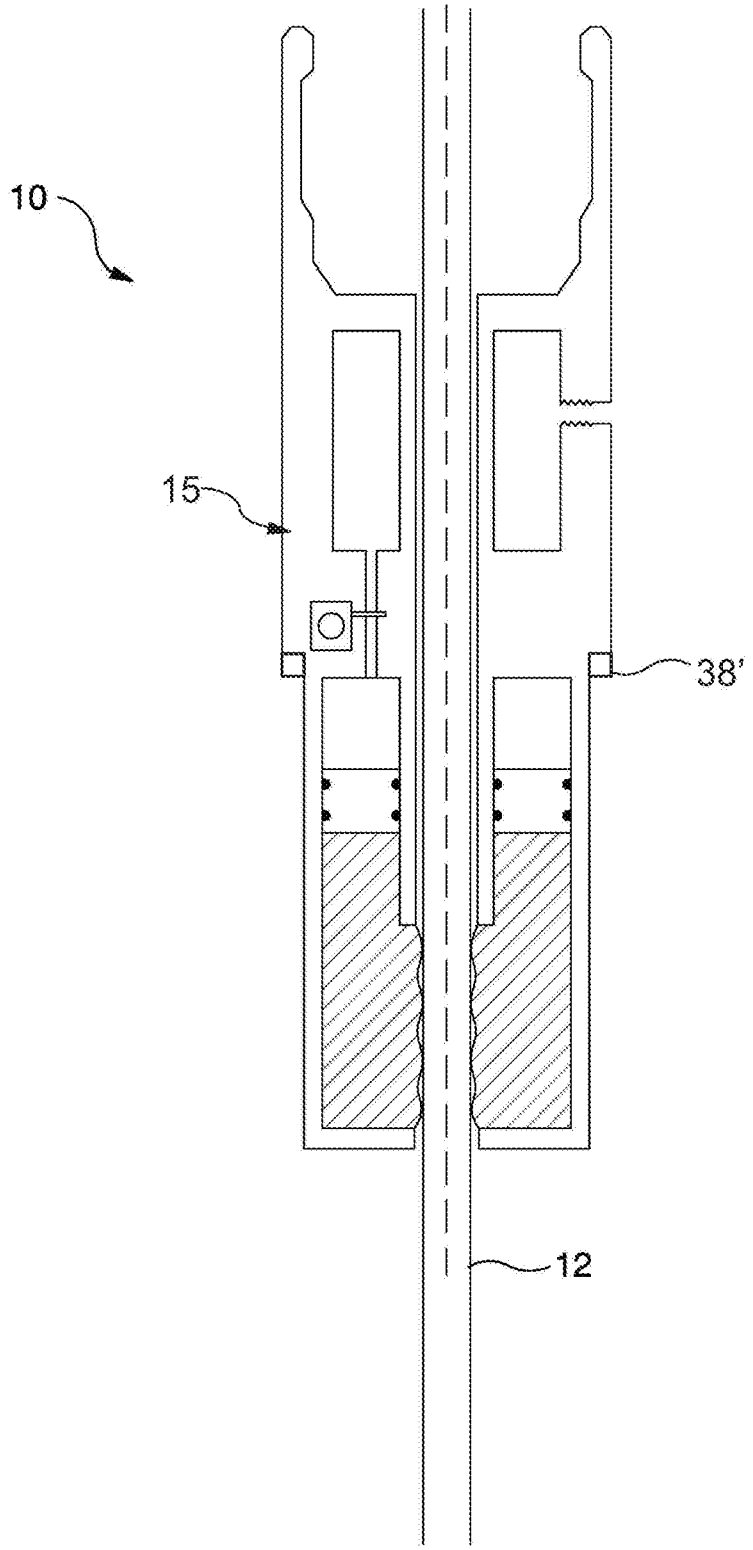
FIG. 2 shows a longitudinal cross-sectional view of the control line space out tool in accordance with another embodiment of the present invention, when gripping a control line.

The locator 38 may comprise a recess or an outwardly projecting flange, shoulder or other projection. The locator 38 may be configured to locate on a cooperating locator 39 provided in the wellbore 50 (for example, in a well head assembly or in production tubing). The wellbore locator 39 may comprise a recess or an inwardly projecting ledge, shoulder or other projection. The tool locator 38, and/or the wellbore locator 39, may be retractable or collapsible (for example, by pressure activation or deactivation) so as to allow the tool 10 to pass further along the wellbore 50. In certain embodiments, one or both of the locators 38, 39 may comprise a welding ring, a spring-loaded (e.g. dog) clip, or an inflatable straddle, such as locator 38' in FIG. 2.

Figure 4:
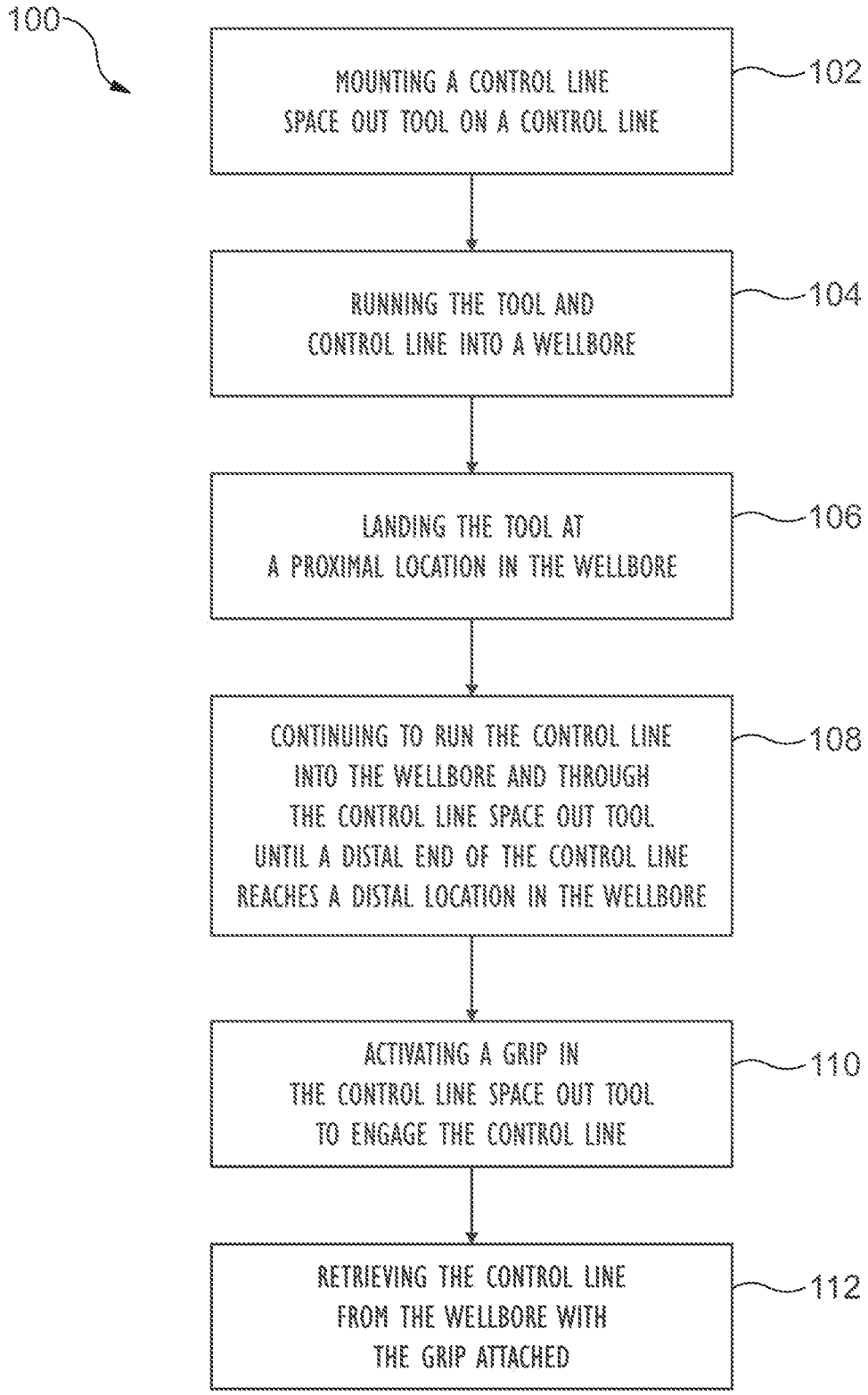
FIG. 4 shows a method of determining a length of control line required to extend between proximal and distal locations within a wellbore.

According to a second aspect of the present invention shown in FIG. 4, there is provided a method 100 of determining a length of control line 12 required to extend between proximal and distal locations within a wellbore comprising: mounting a control line space out tool 10 on a control line 12 (Block 102); running the tool 10 and control line 12 into a wellbore 50 (Block 104); landing the tool 10 at a proximal location in the wellbore 50 (Block 106); continuing to run the control line 12 into the wellbore 50 and through the control line space out tool 10 until a distal end of the control line 12 reaches a distal location in the wellbore 50 (Block 108); activating a grip 32 in the control line space out tool 10 to engage the control line 12 (Block 110); and retrieving the control line 12 from the wellbore with the grip 32 attached (Block 112).

The control line space out tool 10 may be mounted on the control line 12 above a stinger assembly 54 or other tool or device for terminating or coupling the distal end of the control line 12.

The step of landing the control line space out tool 10 at the proximal location in the wellbore 50 (Block 206) may comprise locating the control line space out tool 10 on a locator 39 provided in the wellbore 50.

In a particular embodiment, the control line space out tool 10 may be located on a no-go or ledge 39 provided in a tubing hanger back pressure value (BPV) profile and the method 200 may be employed to determine the length of control line 12 required to extend from a control line hanger (CLH) to be positioned on said no-go or ledge 39 to a tool or device at said distal location, which tool or device may be engaged by a suitable stinger assembly 54.

Once the control line space out tool 10 has landed at the desired location within the wellbore (Block 106), the stinger assembly 54 may be allowed to continue further into the wellbore 50.

The whole space out tool 10 or just the grip 32 may be pulled back to the surface with the control line 12 in order to provide an accurately measured reference point for cutting and terminating the control line 12. Consequently, the method 200 may further comprise cutting the control line 12 to the length indicated by the control line space out tool 10. A control line hanger or other device may then be attached to the upper end of the cut control line 12 and then run into the wellbore 50 to position the device at the proximal location.

It will be appreciated by persons skilled in the art that various modifications may be made to the above embodiments without departing from the scope of the present invention.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A control line space out tool for use in identifying the length of control line required to extend between proximal and distal locations in a wellbore, the control line space out tool comprising:

a body having a locator for locating the tool at a proximal location within a wellbore, and a passage through which a control line may pass to extend to a distal location in the wellbore;

a grip for locking onto the control line; and an actuator for operating the grip to lock onto the control line, wherein the grip serves as an indicator, the position of the grip when locked on the control line indicating the length of the control line required to extend between said proximal and distal locations in the wellbore when the control line is retrieved from the wellbore.

2. The control line space out tool according to claim 1, wherein the grip is configured to couple the entire tool to the control line such that when the control line is retrieved from the wellbore, the tool is carried by the control line to the surface and consequently the position of the tool on the control line serves to indicate the length of control line required to reach the proximal location in the wellbore.

3. The control line space out tool according to claim 1, wherein the grip comprises one or more rubber slips.

4. The control line space out tool according to claim 1, wherein the actuator comprises a pneumatic, hydraulic, mechanical or electrical arrangement for deploying the grip.

5. The control line space out tool according to claim 1, wherein the actuator comprises a pressurised gas chamber arranged, when activated, to operate a piston to force the grip into contact with the control line.

6. The control line space out tool according to claim 1, wherein the actuator is activated by a timer.

7. The control line space out tool according to claim 1, wherein the actuator is activated by a control signal.

8. The control line space out tool according to claim 1, wherein the locator comprises a recess or an outwardly projecting flange, shoulder or other projection.

9. The control line space out tool according to claim 1, wherein the locator is configured to locate on cooperating locator provided in the wellbore.

10. The control line space out tool according to claim 1, wherein the locator comprises a welding ring, a spring-loaded clip, or an inflatable straddle.

11. The control line space out tool according to claim 1, wherein the position of the grip on the control line indicates the position of the tool in the wellbore when the control line is retrieved from the wellbore.

12. A method of determining a length of control line required to extend between proximal and distal locations within a wellbore comprising:

mounting a control line space out tool on a control line;

running the tool and control line into a wellbore;

landing the tool at a proximal location in the wellbore;

continuing to run the control line into the wellbore and through the control line space out tool until a distal end of the control line reaches a distal location in the wellbore;

activating a grip in the control line space out tool to engage the control line; and retrieving the control line from the wellbore with the grip attached, wherein the grip serves as an indicator, the position of the grip when engaged with the control line indicating the length of the control line required to extend between said proximal and distal locations in the wellbore when the control line is retrieved from the wellbore.

13. The method according to claim 12, wherein the control line space out tool is mounted on the control line above a stinger assembly or other tool or device for terminating or coupling the distal end of the control line.

14. The method according to claim 12, wherein the step of landing the control line space out tool at the proximal location in the wellbore comprises locating the control line space out tool on a locator provided in the wellbore.

15. The method according to claim 12, wherein the grip couples the entire tool to the control line such that when the control line is retrieved from the wellbore, the tool is carried by the control line to the surface and consequently the position of the tool on the control line serves to indicate the length of control line required to reach the proximal location in the wellbore.

16. The method according to claim 12, wherein the position of the grip on the control line indicates the position of the tool in the wellbore when the control line is retrieved from the wellbore.

* * * * *